US010267117B2

(12) United States Patent
Bailey et al.

(10) Patent No.: US 10,267,117 B2
(45) Date of Patent: Apr. 23, 2019

(54) RADIAL SEAL PRESSURE REDUCTION USING INTERNAL PUMP

(71) Applicant: WEATHERFORD TECHNOLOGY HOLDINGS, LLC, Houston, TX (US)

(72) Inventors: Thomas F. Bailey, Abilene, TX (US); James W. Chambers, Houston, TX (US); Don M. Hannegan, Fort Smith, AR (US); Lev Ring, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 59 days.

(21) Appl. No.: 15/282,788

(22) Filed: Sep. 30, 2016

(65) Prior Publication Data

US 2017/0114606 A1 Apr. 27, 2017

Related U.S. Application Data

(60) Provisional application No. 62/246,734, filed on Oct. 27, 2015.

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS 3,943,717 A * 3/1976 Schexnayder ..... F16J 15/004 277/513
5,647,444 A * 7/1997 Williams ..... E21B 33/085 166/84.1
2009/0194921 A1 8/2009 Smith et al.
2010/0307772 A1* 12/2010 Bailey ..... E21B 33/085 166/387
2011/0024195 A1 2/2011 Hoyer et al.
2011/0036638 A1 2/2011 Sokol et al.
2011/0127725 A1 6/2011 Dietle

FOREIGN PATENT DOCUMENTS

EP 2261457 A2 12/2010

OTHER PUBLICATIONS

International Search Report with Written Opinion dated Jan. 11, 2017 for PCT Patent Application No. PCT/US2016/054873, 11 pages.
Kalsi; "Centrifugal Pump K-Cartridge", company brochure PN 534-6 Rev. 3, dated 2005-2012, 2 pages.

* cited by examiner

*Primary Examiner* — Kristina R Fulton
*Assistant Examiner* — L. Susmitha Koneru
(74) *Attorney, Agent, or Firm* — Smith IP Services, P.C.

(57) ABSTRACT

A pressure control device for sealing about a tubular at a wellsite can include a rotatable member, at least two radial seals that sealingly contact the rotatable member, at least two fluid chambers, one chamber being exposed to the rotatable member between the radial seals, and a pump that pumps fluid between the chambers in response to rotation of the rotatable member. A method of operating a pressure control device at a wellsite can include providing at least two chambers in a bearing assembly of the pressure control device, and regulating pressures in the chambers via a valve system in communication with both of the chambers.

12 Claims, 13 Drawing Sheets

| STAGE | WELL BORE | TOP CHAMBER PRESSURE | BOTTOM CHAMBER PRESSURE |
|---|---|---|---|
| 1 | 0 | 50 | 550 |
| 2 | 250 | 50 | 550 |
| 3 | 500 | 50 | 550 |
| 4 | 600 | 100 | 650 |
| 5 | 800 | 350 | 850 |

| DOCKING STATION | | | |
|---|---|---|---|
| WELL BORE | HYD. CHAMBER | ΔP LOWER SEAL | ΔP UPPER SEAL |
| 0 | 50 | 50 | 50 |
| 500 | 550 | 50 | 550 |
| 1000 | 1050 | 50 | 1050 |
| 1500 | 1550 | 50 | 1550 |

FIG.5

| NEW CONCEPT WITH INTERNAL PUMP | | | | |
|---|---|---|---|---|
| WELL BORE | LOWER CHAMBER | ΔP LOWER SEAL | UPPER CHAMBER | ΔP UPPER SEAL |
| 0 | 500 | 500 | 50 | 50 |
| 500 | 550 | 50 | 50 | 50 |
| 1000 | 1050 | 50 | 550 | 550 |
| 1500 | 1550 | 50 | 1050 | 1050 |
| 2000 | 2050 | 50 | 1550 | 1550 |

FIG.6

| STAGE | WELL BORE | TOP CHAMBER PRESSURE | BOTTOM CHAMBER PRESSURE | CHECK VALVE | PILOT LINE P V2 | PILOT LINE P V3 | 200psi RELIEF V2 | 5psi RELIEF V3 | 500psi RELIEF |
|---|---|---|---|---|---|---|---|---|---|
| 1 | 0 | 50 | 250 | OPEN | 0 | 0 | CLOSED | CLOSED | CLOSED |
| 2 | 250 | 100 | 300 | OPEN | 0 | 0 | CLOSED | CLOSED | CLOSED |
| 3 | 500 | 350 | 550 | CLOSED | 350 | 350 | OPEN | CLOSED | CLOSED |
| | 500 | 50 | 550 | CLOSED | 55 | 55 | CLOSED | OPEN | OPEN |
| 4 | 200 | 50 | 250 | OPEN | 55 | 55 | CLOSED | OPEN | CLOSED |

| STAGE | WELLBORE | TOP CHAMBER PRESSURE | BOTTOM CHAMBER PRESSURE | CLUTCH | PILOT LINE P V2 | 200psi RELIEF V2 | 500psi RELIEF |
|---|---|---|---|---|---|---|---|
| 1 | 0 | 50 | 50 | DISENGAGED | 0 | CLOSED | CLOSED |
| 2 | 250 | 50 | 300 | ENGAGED | 300 | OPEN | CLOSED |
| | 250 | 50 | 550 | ENGAGED | 550 | OPEN | OPEN |
| 3 | 100 | 50 | 550 | ENGAGED | 550 | OPEN | OPEN |
| | 100 | 50 | 150 | DISENGAGED | 50 | CLOSED | CLOSED |
| 4 | 200 | 50 | 250 | ENGAGED | 250 | OPEN | CLOSED |
| | 200 | 50 | 550 | ENGAGED | 550 | OPEN | OPEN |

RADIAL SEAL PRESSURE REDUCTION USING INTERNAL PUMP

CROSS-REFERENCE TO RELATED APPLICATION

This application claims the benefit of the filing date of U.S. provisional application No. 62/246,734, filed 27 Oct. 2015. The entire disclosure of this prior application is incorporated herein by this reference.

BACKGROUND

This disclosure relates generally to the field of well drilling technology and, in one example described below, more particularly provides a technique for reducing pressure differential across radial seals.

In well drilling operations, it is sometimes desirable to isolate from atmosphere an annulus formed radially between a wellbore and a tubular string. The tubular string may be of the type known to those skilled in the art as a drill string, which is used to drill the wellbore into the earth.

To isolate the annulus from atmosphere, seals (sometimes known as "stripper rubbers") are typically positioned about the tubular string, to sealingly engage the tubular string and seal off the annular space about the tubular string. If the seals rotate with the tubular string, the seals may be included in a well tool known to those skilled in the art as a rotating control device ("RCD"), rotating drilling head or rotating blowout preventer. More generally, a well tool comprising such seals is known as a drilling head or pressure control device, whether or not the seals rotate with the tubular string.

It will, thus, be readily appreciated that improvements are continually needed in the arts of constructing and utilizing drilling heads or pressure control devices for well drilling operations. Such improvements can include features that increase a useful life of radial seals in drilling heads or pressure control devices.

BRIEF DESCRIPTION OF THE DRAWINGS

FIG. 5 is a representative table of pressure values for upper and lower radial seals during operation without use of the radial seal pressure reduction system.

FIG. 6 is a representative table of pressure values for upper and lower radials seals during operation utilizing the radial seal pressure reduction system.

DETAILED DESCRIPTION

In rotary sealing applications, a useful life of a radial seal is typically limited by an amount of differential pressure across the seal, and a relative rotational velocity between the seal and a surface sealingly engaged by the seal. As the pressure or velocity is increased, the usable life of the seal generally decreases. If the pressure and/or velocity can be reduced, seal life can be extended. Where multiple radial seals are used, a "top" seal exposed to the atmosphere may fail prior to a "bottom" seal exposed to annulus pressure, since the top seal typically experiences a higher differential pressure, although the bottom seal may experience greater exposure to abrasive wellbore mud.

Figure 1:
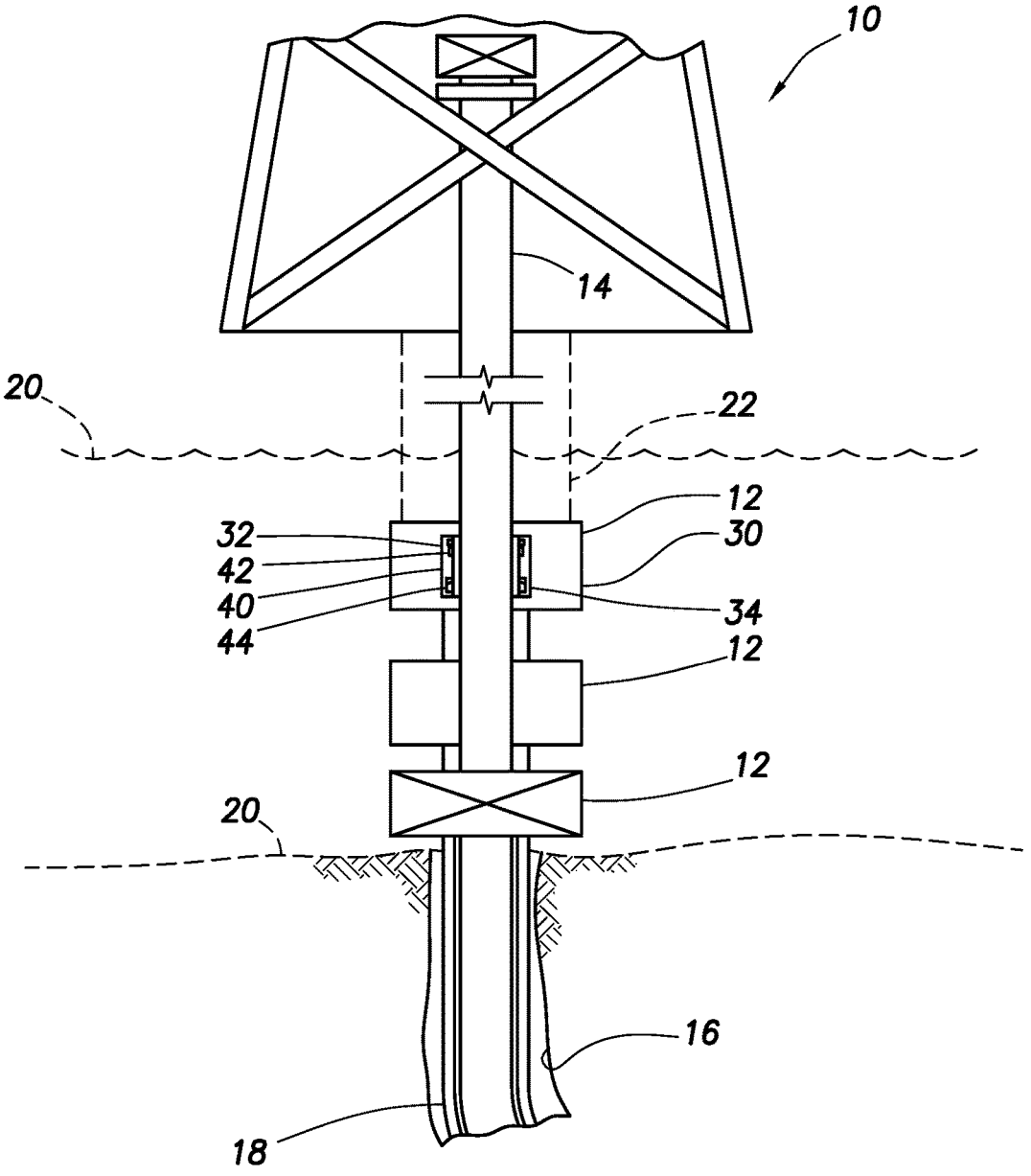
FIG. 1 is a representative schematic view of a wellsite at which an example of a radial seal pressure reduction system incorporating principles of this disclosure is utilized.

Representatively illustrated in FIG. 1 is a wellsite 10 and associated method which can embody principles of this disclosure. However, it should be clearly understood that the wellsite 10 and method are merely one example of an application of the principles of this disclosure in practice, and a wide variety of other examples are possible. Therefore, the scope of this disclosure is not limited at all to the details of the wellsite 10 and method described herein and/or depicted in the drawings.

In the FIG. 1 example, one or more pressure control devices 12 are provided at the wellsite 10 for sealing about a rotating drill string or other tubular 14. The wellsite 10 may have a wellbore 16 formed in the earth and lined with a casing 18.

Although the wellsite 10 depicted in FIG. 1 is land-based, it should be appreciated that the principles of this disclosure may be practiced in alternate environments, including, but not limited to, offshore and other water-based locations. Further, although the wellbore 16 is depicted as being primarily vertical, the principles of this disclosure may be practiced with deviated, horizontal, curved, inclined or otherwise oriented wellbores.

At the earth's surface or sea floor 20, or above a riser 22 (see, for example, US Publication No. 2014/0027129 FIGS. 1, 1A & 1B and accompanying description depicting exemplary schematic views of fixed offshore rig and land wellsites, the disclosure of which is incorporated herein by reference) the one or more pressure control devices 12 may be used control pressure in the wellbore 16. The pressure control devices 12 may include, but are not limited to, blowout preventers ("BOP's"), RCD's 30, and the like.

The pressure control device 12 in this example is a drill-through device with a rotating seal that contacts and seals against the tubular 14 to isolate well pressure from atmosphere. The seal blocks flow through an annulus surrounding the tubular 14 in the pressure control device 12. The tubular 14 may be any suitable equipment to be sealed by the pressure control device 12 including, but not limited to, a tubular, a drill string, a bushing, a bearing, a bearing assembly, a test plug, a snubbing adaptor, a docking sleeve, a sleeve, sealing elements, a drill pipe, a tool joint, and the like.

As depicted in FIG. 1, an upper pressure control device 12 is an RCD 30. A radial seal pressure reduction device or system 40 may be part of a bearing assembly 32 disposed in the RCD 30.

The pressure reduction system 40 may include radial seals 42, 44 configured to engage/contact and seal against an inner rotatable member 34 during oilfield operations. The inner rotatable member 34 may be any suitable, rotatable equipment to be sealed by the radial seals 42, 44. In the RCD 30, the rotatable member 34 is a generally tubular inner mandrel.

Referring additionally now to FIGS. 2A-2D, cross-sectional views of an example of the radial seal pressure reduction system 40 in the bearing assembly 32 of the RCD 30 is representatively illustrated. The bearing assembly 32 includes stationary and rotatable members 34, 54, and bearings 38.

In the example of FIG. 2A-2D, the bearings 38 comprise roller bearings, but may also (or alternatively) comprise other types of bearings, such as, but not limited to, thrust bearings and journal bearings (not illustrated but if used in substitution of the roller bearings may require greater lubrication, such as, an assurance of lubricant film between rotating components and non-rotating components upon initial start up to prevent galling). At lower differential pressures, parts of the optional journal bearings, such as an inner and/or outer race, may be constructed of material other than steel, such as brass and bronze alloys, Babbitt metal, impregnated composite plastic, nylon, and so on.

One rotatable member 34 may be a wear sleeve or wear ring 36, against which radial upper or top seals 42 and radial lower or bottom seals 44 may engage or seal against. As depicted, the upper seals 42 are a set of two radial seals 45, positioned in series. However, in other examples, a greater or lesser number of radial seals 45 may be used. The lower seals 44 are also depicted as a set of two radial seals 45, the number of which may also be changed as desired.

The radial seals 42, 44 may comprise any suitable sealing material including, but not limited to, elastomers, plastics, composites, metal and the like. The upper and lower seals 42,44 may be constructed of the same or different materials. By way of example only, the lower seals 44 may be KALSI™ seals, marketed by Kalsi Engineering, Inc. of Sugar Land, Tex. USA.

An upper end 32*a* of the bearing assembly 32 may be located or positioned toward an atmospheric, surface 20, or lower pressure area than a lower end 32*b* of the bearing assembly 32, which may be located or positioned toward a higher pressure area or the wellbore 16 (see FIG. 1). Additionally, the bearing assembly 32 may also include an optional inflatable gripper or expandable drill pipe gripper 31 for engaging the tubular 14.

An upper or top compensator 60 may be located toward the upper end 32*a* of the bearing assembly 32, and a lower or bottom compensator 70 may be located toward the lower end 32*b* of the bearing assembly 32. The compensators 60, 70 may each include a compensator piston 62, 72, a compensator fluid chamber 64, 74, a spring 66, 76, and a volume of fluid 68, 78, respectively.

The pistons 62, 72 may be biased, respectively, by the springs 66, 76 against the compensator fluid chambers 64, 74 to compress the volumes of fluid 68, 78 and achieve desired pressures in the chambers 64, 74. The pistons 62, 72 are adjustable and/or moveable within the chambers 64, 74 and against the fluid 68, 78 to modify the pressure to a desired value, and may modify the chamber pressure based on environmental pressure surrounding the respective ends 32*a*, 32*b* of the bearing assembly 32 (e.g., the upper compensator 60 is responsive to the surface 20 or upper area pressure (including atmospheric pressure or pressure internal to the riser 22, if a riser is used), and the bottom compensator 70 is responsive to pressure in the wellbore 16 or bottom area pressure).

By way of example only, the chambers 64, 74 may be compressed to a slightly higher pressure of at least fifty 50 psi over the surface 20, riser 22 or wellbore 16 pressure, as the case may be, at the respective end 32*a*, 32*b* of the bearing assembly 32 or RCD 30 for use in regulating pressure differentials. While the upper chamber 64 may be maintained at a pressure of at least 50 psi (~345 kPa) greater than the external pressure when the upper chamber 64 pressure is relatively low, when the upper chamber 64 pressure is relatively high, the differential pressure across the upper seals 42 may be greater than 50 psi (~345 kPa).

Another purpose of the chambers 64, 74 is to maintain a volume of fluid 51 against the seals 45. With a pump 50, relief valve 56 or valve systems (for example, valve systems 82, 98 examples of FIGS. 8 & 12, respectively), the fluid volume 51 in the upper chamber 64 can vary some. The upper piston 62, biased by the spring 66, ensures that there is always fluid on the upper seals 42 to keep them lubricated.

In this example, when there is no wellbore 16 pressure acting on the piston 72, or riser 22 pressure acting on the piston 62, then the fluid 68, 78 pressure inside the chambers 64, 74 will be related to the biasing forces of the respective springs 66, 76. When the wellbore 16 pressure is greater than zero, the pressures in the chambers 64, 74 will be equal to the wellbore 16 pressure as added to the pressure due to the forces exerted by the respective springs 66, 76. When the riser 22 pressure is greater than zero, and the wellbore 16 pressure and riser 22 pressure are equal, then the pressures in chambers 64 and 74 will be equal to the riser 22 pressure as added to the pressure due to the forces exerted by the respective springs 66, 76.

Figure 2A:
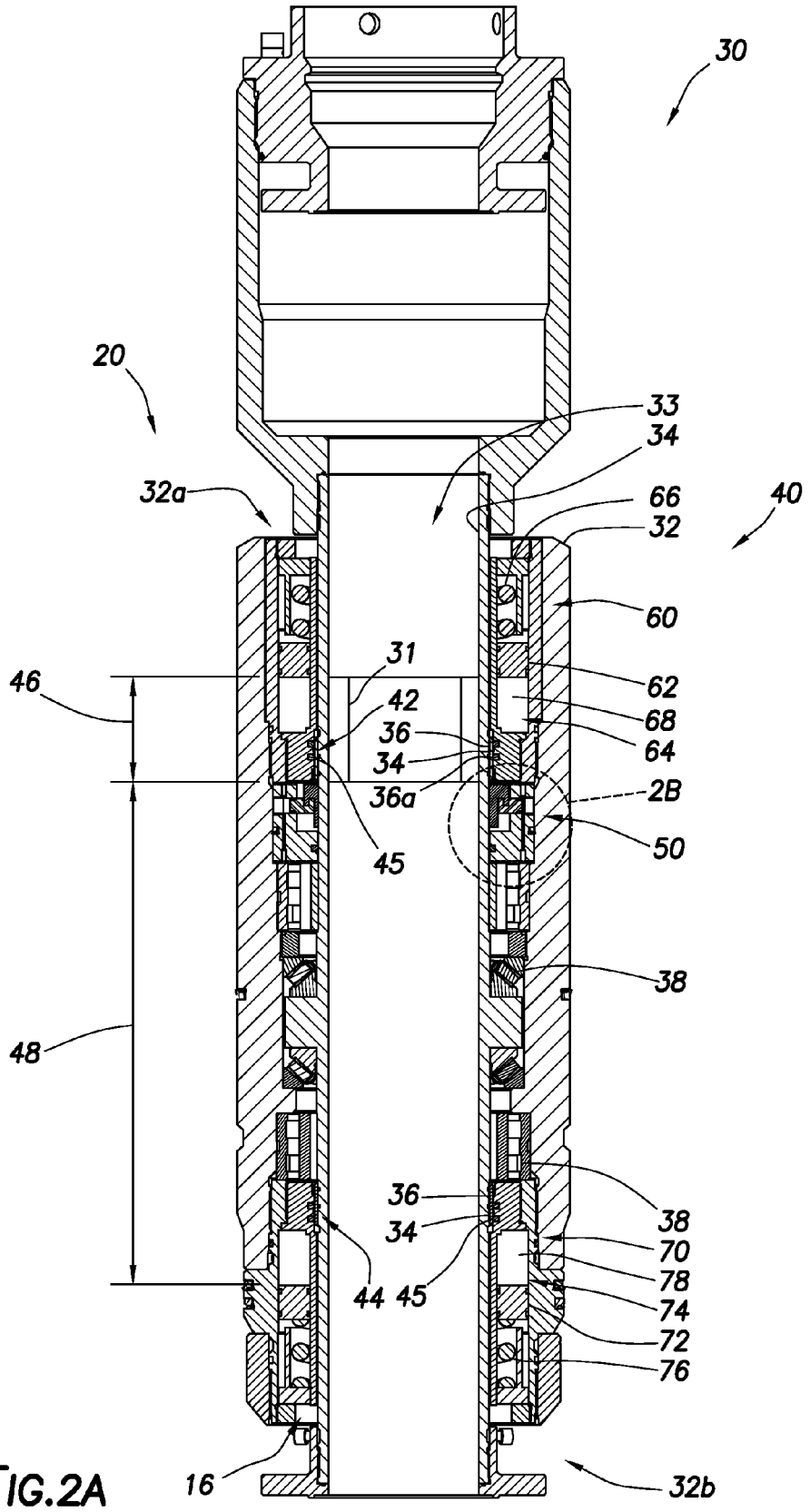
FIG. 2A is a representative cross-sectional view of an example of the radial seal pressure reduction system.

The radial seal pressure reduction system 40 may include two chambers, generally represented in FIG. 2A as an upper chamber 46 and a lower chamber 48, with a pump 50. The pump 50 may move a volume of fluid 51 between the two chambers 46, 48. In the FIGS. 2A-C example, the volume of fluid 51 may be any type of compressible fluid, including gases or liquids, as desired.

In the depicted example of FIG. 2A, the upper chamber 46 may be defined as beginning at a lower end of upper compensator piston 62, inclusive of the upper compensator fluid chamber 64, and ending at the upper seals 42 (and proximate the bottom of the upper wear sleeve 36*a*, above the pump 50). The lower chamber 48 in FIG. 2A may be defined as beginning at the upper seals 42 (and proximate pump 50, inclusive of the pump 50), and extending to the bottom compensator fluid chamber 74 and at the lower seals 44.

Figure 2B:
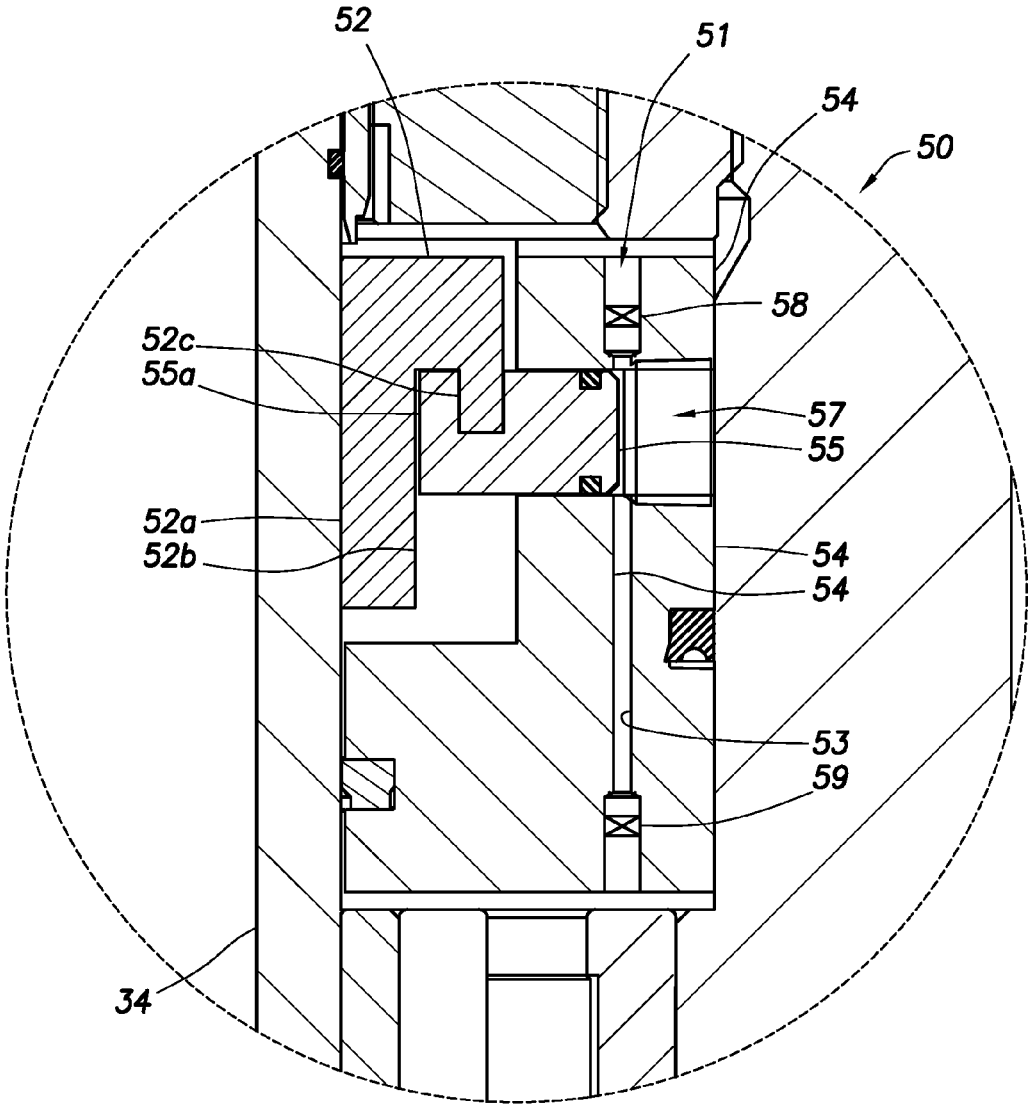
FIG. 2B is a representative enlarged scale cross-sectional view of the radial seal pressure reduction system of FIG. 2A, wherein a piston of a pump is extended.
Figure 2C:
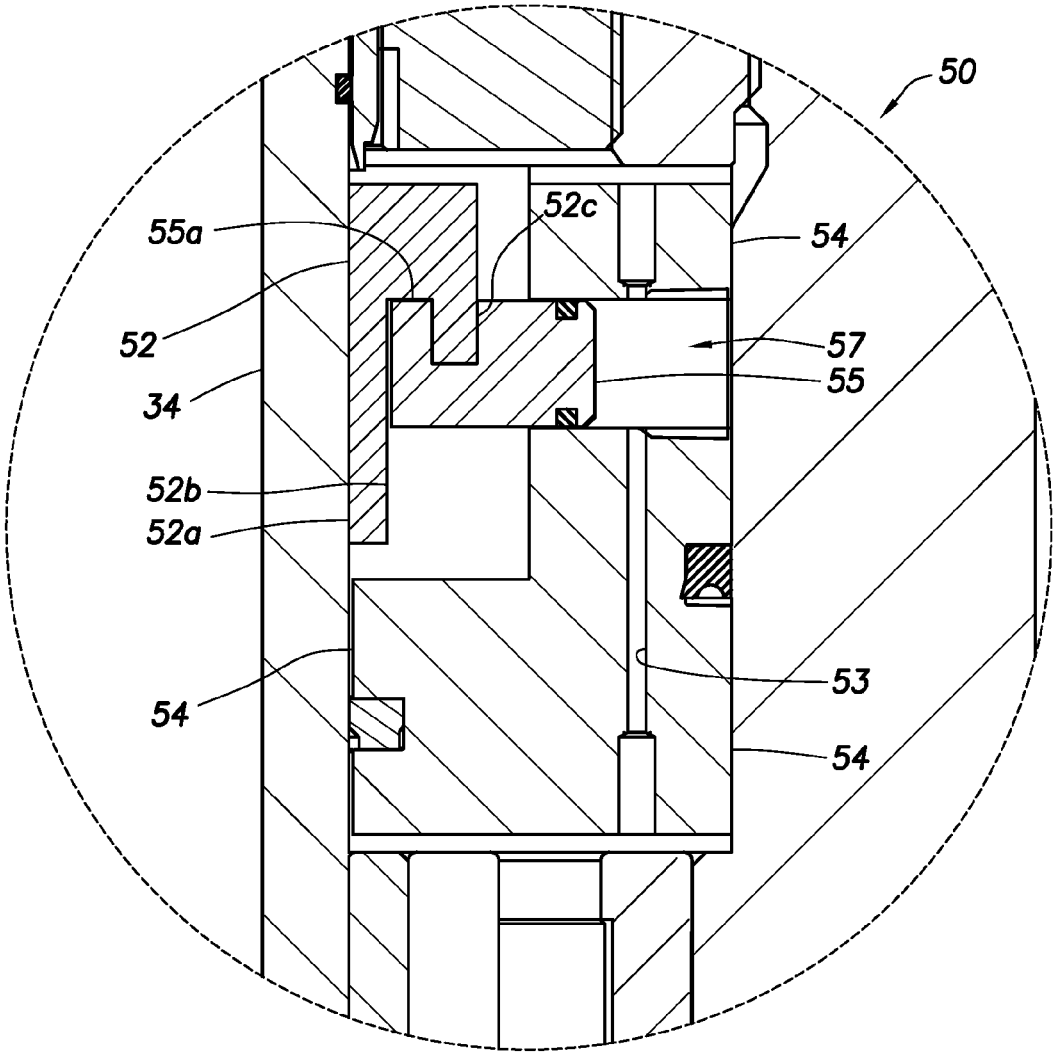
FIG. 2C is a representative cross-sectional view of the radial seal pressure reduction system of FIG. 2A, wherein the piston of the pump is retracted.
Figure 2D:
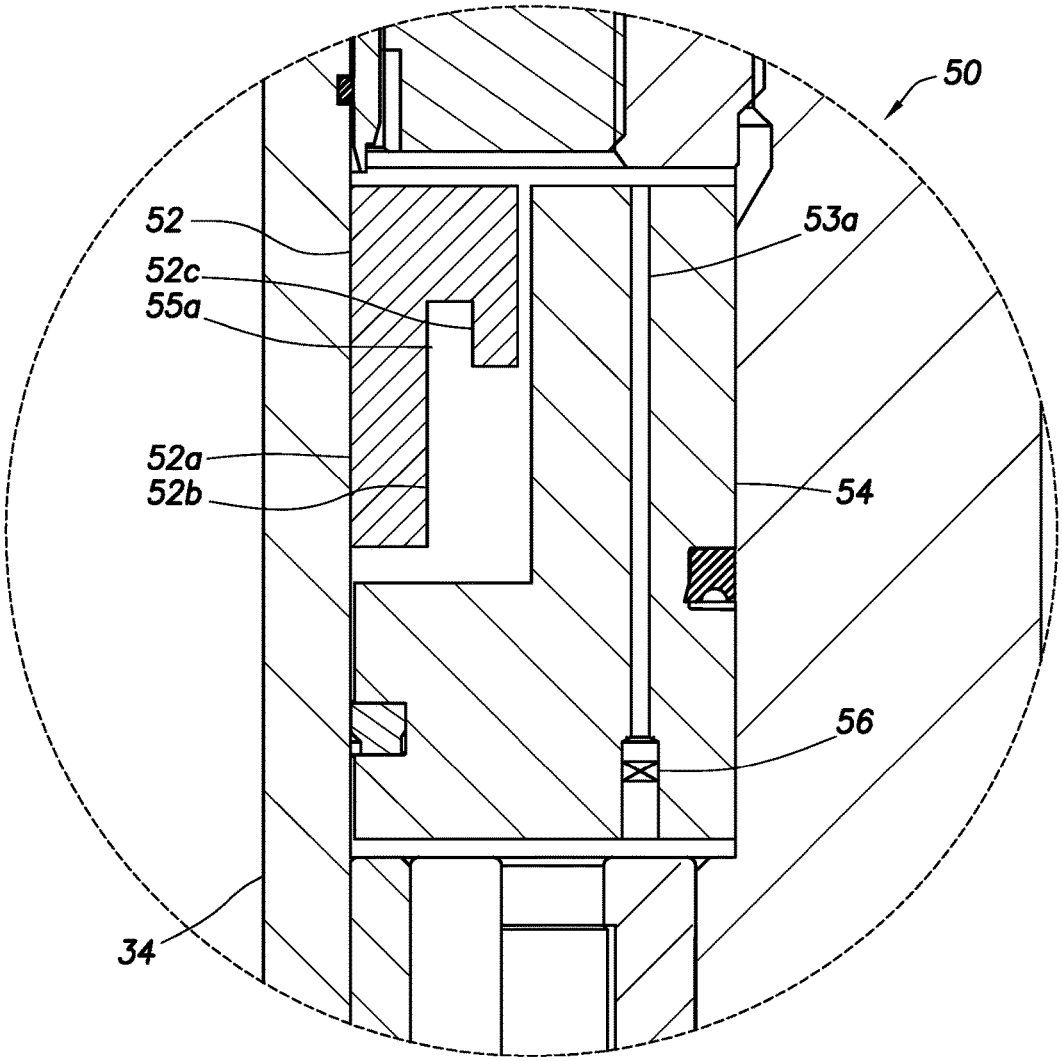
FIG. 2D is a representative alternate cross-sectional view of the radial seal pressure reduction system of FIG. 2A.

FIGS. 2B & C depict enlarged cross-sectional views of an example of the pump 50 of the radial seal pressure reduction system 40 of FIG. 2A. FIG. 2D depicts an alternate example of the pump 50. It should be appreciated that any types, means and combinations of pumps and/or valve systems as known in the art may be used to relieve, transfer, move or adjust fluid for the pressure reduction system 40 between the chambers 46, 48, and that the scope of this disclosure is not limited to any details of the pump 50 as described herein or depicted in the drawings.

The pump 50 is depicted as being a radial pump 50 in this example, but in other examples the pump 50 could be a screw pump, a Moineau pump, a rotary seal effectively functioning as a pump (e.g., as in the example of FIG. 14), or the like, etc. In the present example, the pressure reduction system 40 may include four pumps 50 distributed circumferentially about a through bore 33 of the bearing assembly 32, although any number of pumps 50 may be used as desired.

The examples of the pump 50 depicted in FIGS. 2A-2D include a rotatable member or wobble sleeve 52 which may rotate in response to, or in conjunction with, rotational movement of the bearing assembly 32. The pump 50 may also include a stationary member 54, which does not rotate as the bearing assembly 32 rotates. The stationary member 54 may define, for example, four spaces or voids 57 (together with a top of a piston 55) and one or more flow paths 53, through which the volume of fluid 51 may flow.

The wobble sleeve 52 has an extended or pump driver piece 52*a* which has a varying thickness or outer diameter 52*b* (in cross-section) creating eccentricity about a circumference of the wobble sleeve 52. The sleeve 52 is represented at its thickest/piston 55 fully extended position in FIG. 2B, and is represented at its thinnest/piston 55 fully retracted position in FIG. 2C.

The wobble sleeve or eccentric piece 52 may also have a circumferential lip 52*c* for supporting the four pistons 55, and for connecting or joining to an arm 55*a* of each respective piston 55. As the wobble sleeve 52 rotates, the changing outer diameter 52*b* of the extended piece 52*a* will extend and retract the piston 55 radially into and out of the respective spaces 57, thus compressing and decompressing the volume of fluid 51 in the respective spaces 57 and flow paths 53 (as regulated by check valves 58, 59 and/or relief valve 56).

At an upper end of the pump 50, where the fluids 68, 51 may enter into the pump 50 from the upper chamber 46, there may be an inlet check valve 58 (see FIG. 2B) through which the volume of fluids 68, 51 may travel. At a lower end of the pump 50, the fluid 51 may exit the pump and communicate pressure into the lower chamber 48 through the outlet check valve 59 (see FIG. 2B) or the relief valve 56 (see FIG. 2D).

These valves 56, 58 and 59 may be positioned along, and control or allow flow through, the flow paths 53. In one example, the inlet check valve 58 and the outlet check valve 59 (FIG. 2B) may be located on a separate flow path 53 in a different plane than the flow path 53*a* on which the relief valve 56 (FIG. 2D) is located.

The bearing assembly 32 may also optionally include sensors (not illustrated) to detect a level of pressure present in the particular flow path 53 on which the valves 56, 58 and/or 59 are situated. Such sensors could be located, by way of example, for monitoring pressure in the compensator fluid chambers 64, 74 to derive the pressure in the flow paths 53. By way of example only, these sensors could include wireless or inductive transmitters that would allow the bearing assembly 32 to be installed or removed remotely from the RCD 30.

Figures 3, 4:
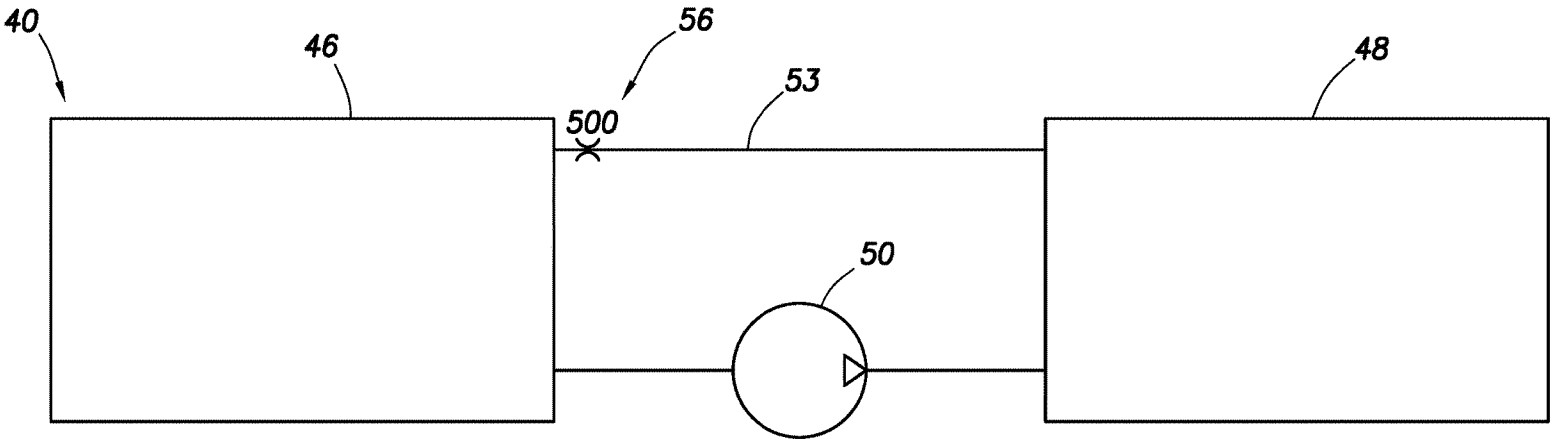
FIG. 3 is a representative schematic view of another example of the radial seal pressure reduction system.
FIG. 4 is a representative table of pressure values in the radial seal pressure reduction system during operation.

Referring additionally now to FIG. 3, a schematic view of an example of the radial seal pressure reduction system 40 is representatively illustrated. In this example, each relief valve 56 is set to open at 500 psi (~3447 kPa) of differential pressure, with there being four total relief valves through the stationary member/piston housing 54.

The top chamber 46 and bottom chamber 48 are fluidly connected by the flow paths 53, in which pressure is modified and controlled by the pump 50 and the relief valve 56. The pump 50 is driven or manipulated by the rotating inner member(s) 34 of the bearing assembly 32 to regulate the pressures in the chambers 46, 48 internal to the bearing assembly 32.

Fluid is pumped between the two chambers 46, 48 in order to regulate, maintain and/or adjust the pressures in the chambers 46, 48. Once the pressure generated by the pump 50 is enough to overcome the relief valve's 56 set pressure, the relief valve 56 opens, thereby limiting pressure in the chamber 48 to the relief valve 56 pressure set point. In one example, three hundred and six revolutions of the wobble sleeve 52 would pump approximately one gallon (~3.78 liters) of fluid.

FIG. 4 depicts an example of a table of pressure values for the wellbore 16, the top chamber 46 and the bottom chamber 48 at different stages of a wellsite 10 operation utilizing the pressure reduction system 40 of FIG. 3. In stages 1-2, the bottom chamber 48 pressure is maintained around 550 psi (~3800 kPa). For example, 500 psi (~3447 kPa) is generated by operation of the pump 50, and 50 psi (~344.7 kPa) due to the spring 76 exerting a biasing force on the bottom compensator piston 72.

In stages 3-5, the bottom chamber 48 pressure is increased to approximately 50 psi (~344.7 kPa) above the wellbore 16 pressure, due to the force of the spring 76 transmitted via the bottom compensator piston 72 to a cross-sectional area of the bottom compensator fluid chamber 74 (which also forms part of, and contributes to the pressure of, the bottom chamber 48). Because the relief valve 56 is set to relieve pressure at 500 psi (~3447 kPa), the difference in pressure between the top chamber 46 and the bottom chamber 48 is 500 psi (~3447 kPa) across all stages 1-5.

Assuming that atmospheric pressure is zero (gauge pressure), in stage 1 of the table in FIG. 4, the differential pressure exerted on the top seals 42, between the top chamber 46 and the atmosphere, surface or upper area 20, is 50 psi (~344.7 kPa), and the differential pressure exerted on the bottom seals 44, between the bottom chamber 48 and the wellbore 16, is 550 psi (~3800 kPa). In stage 2, while the wellbore 16 pressure is at 250 psi (~1725 kPa), the differential pressure across the top seal 42 is maintained at 50 psi (~344.7 kPa), and the differential pressure across the bottom seal is 300 psi (~2070 kPa).

When the wellbore 16 pressure reaches 500 psi (~3447 kPa) at stage 3, the differential pressure across the top seal 42 is 50 psi (~344.7 kPa), and the differential pressure across the bottom seal 44 is reduced to 50 psi (~344.7 kPa). At stage 4, the wellbore 16 pressure reaches 600 psi (~4140 kPa) and the differential pressure across the bottom seal 44 is 50 psi (~344.7 kPa), while the top seal 42 reaches a differential pressure of 100 psi (~690 kPa).

At the last stage 5 of the FIG. 4 table, the top seal 42 has a differential pressure of 350 psi (~2415 kPa), while the bottom seal 44 has a differential pressure of 50 psi (~344.7 kPa). By way of example only, the seals 42, 44 may be rated for a differential pressure of up to 1500 psi (~10.35 MPa). Accordingly, the pressure rating of the bearing assembly 32 can be increased, without necessitating use of an external hydraulic lubrication system (although an external lubrication system may be used if desired).

For purpose of comparison, FIG. 5 depicts an example table of pressure values for upper radial seals 42 and lower radial seals 44, as if the pressure reduction system 40 is not utilized (i.e., the top chamber 46, bottom chamber 48, pump 50 and relief valve 56 are not used). Instead, the system in FIG. 5 could utilize a commercially available single hydraulic chamber that is flanked by an upper seal 42 toward the atmosphere or surface 20 (assumed to be at zero gauge pressure), and a lower seal 44 toward the wellbore 16.

In the table of FIG. 5, it is apparent that, as the wellbore 16 pressure increases, the differential pressure across the lower seal 44 may remain the same at 50 psi (~344.7 kPa) via adjusting or increasing the pressure in the single hydraulic chamber accordingly. However, in so doing, the differential pressure across the upper seal 42 may eventually exceed the example rating of 1500 psi (~10.35 MPa) when the wellbore 16 pressure reaches 1500 psi (~10.35 MPa).

In contrast, FIG. 6 depicts an example table of pressure values for the upper radial seals 42 and lower radial seals 44 as if the radial seal pressure reduction system 40 is utilized. The pressure values of FIG. 5 can be compared with those of FIG. 6 to demonstrate that the pressure rating of the equipment can be increased by use of the radial seal pressure reduction system.

Note that, at a wellbore pressure of 1500 psi (~10.35 MPa), the differential pressure across the upper seal 42 is 1050 psi (~7.2 MPa) with the pressure reduction system 40 (FIG. 6 table), the same differential pressure as at 1000 psi (~6.9 MPa) without the pressure reduction system 40 (FIG. 5 table). Thus, the equipment (e.g., the bearing assembly 32, RCD 30, pressure control device 12, etc.) utilizing the pressure reduction system 40 can operate at a higher wellbore 16 pressure for a given differential pressure across the upper seal 42.

Figure 7:
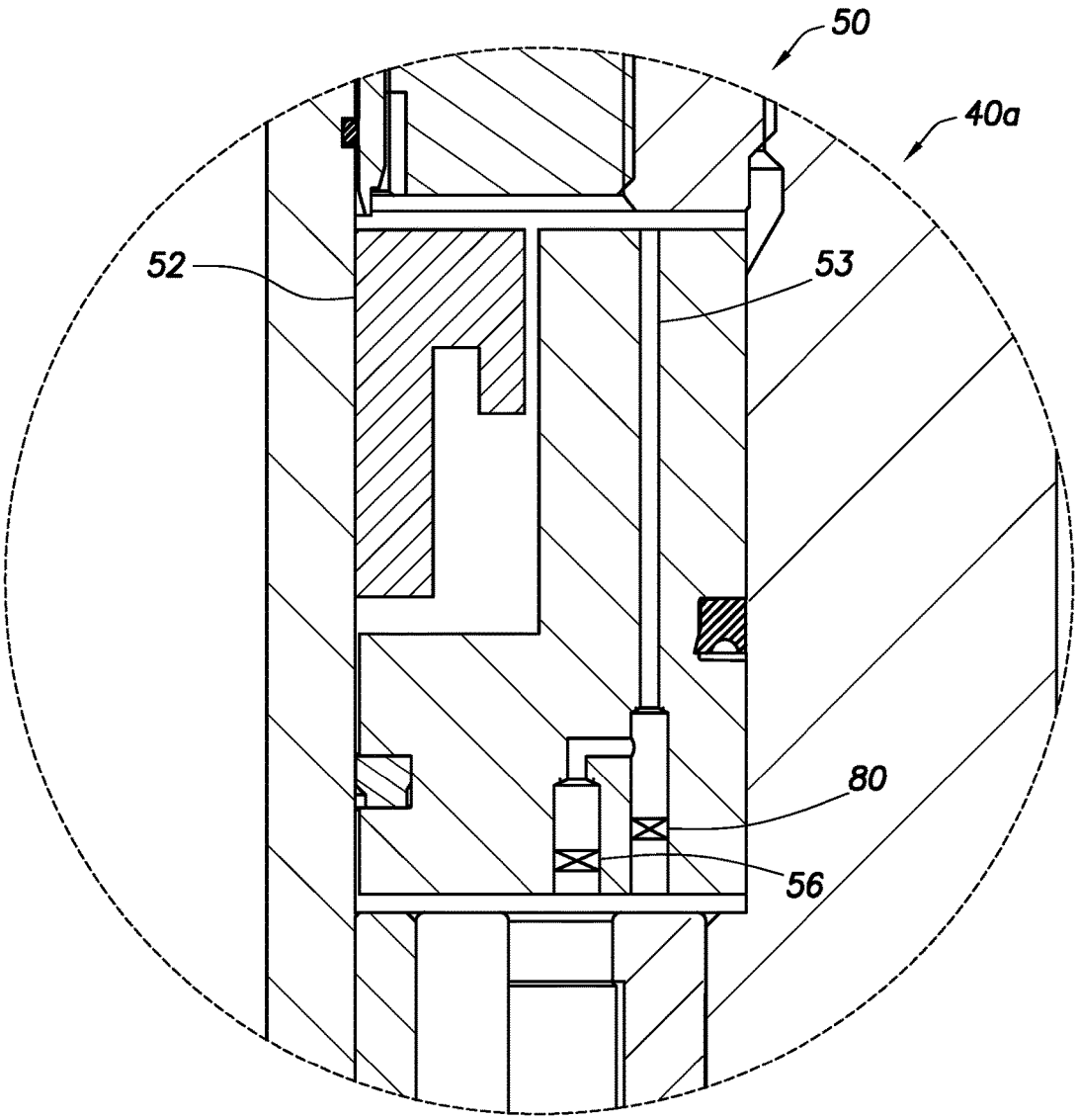
FIG. 7 is a representative partially cross-sectional view of another example of the radial seal pressure reduction system.

Referring additionally now to FIG. 7, a partial cross-sectional view of another example of the radial seal pressure reduction system 40*a* is representatively illustrated. The wobble sleeve 52 is visible in FIG. 7, however, the illustrated cross-section is not in a plane in which the piston(s) 55 are visible.

Figures 8, 9:
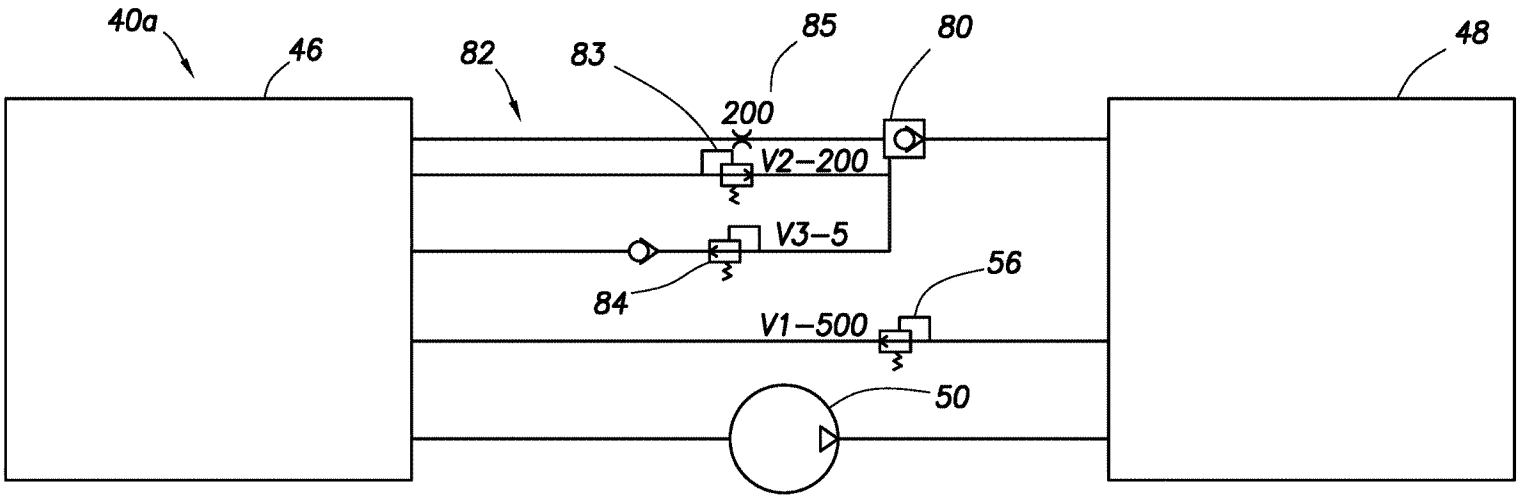
FIG. 8 is a representative schematic view of the radial seal pressure reduction system of FIG. 7.
FIG. 9 is a representative table of pressure values during operation utilizing the radial seal pressure reduction system of FIGS. 7 & 8.

FIG. 8 depicts a schematic view of the radial seal pressure reduction system 40*a* of FIG. 7. In the FIGS. 7 & 8 example, the pressure reduction system 40*a* includes a bypass valve system 82 to equalize the bearing assembly 32 at relatively low wellbore 16 pressures (such as, by way of example, wellbore 16 pressures lower than ~3.4 MPa) until the wellbore 16 pressure increases to the setting of the relief valve 56.

The bypass valve system 82 may include, by way of example, a pilot operated to close check valve 80, a relief valve 83 set at 200 psi (~1380 kPa), a relief valve 84 set at 5 psi (~35 kPa) and an orifice 85. The orifice 85 may be configured to allow flow from the lower chamber 48 to the upper chamber 46, while also holding a back pressure, by way of example only, of 200 psi (~1380 kPa).

Referring additionally now to FIG. 9, a table of pressure values at different stages of a wellsite 10 operation utilizing the FIGS. 7 & 8 example of the radial seal pressure reduction system 40*a* is representatively illustrated. The FIG. 9 table indicates the bypass valve system 82 maintaining a lower pressure differential across the lower or bottom seal 44 at relatively low wellbore 16 pressures in stages 1 and 2, as compared to that in the FIGS. 4 & 6 examples.

In the examples of FIGS. 4 & 6, at lower wellbore 16 pressures (such as zero wellbore pressure) the differential pressures across the bottom seal 44 may be around 500 psi (~3447 kPa). However, in the example of FIGS. 7 & 8, and as shown in the table of FIG. 9, the pressure differential across the bottom seal 44 at zero wellbore 16 pressure may be decreased to 250 psi (~1.7 MPa) by utilizing the bypass valve system 82.

In the FIGS. 7-9 example, the pump 50 pumps fluid from the upper chamber 46 into the lower chamber 48. The orifice 85 creates a pressure drop to prevent the chambers 46 and 48 from being at the same pressure. By sizing the orifice 85 back pressure appropriately, the pressure differential between chambers 46 and 48 can be at a desired level.

The check valve 80 prevents flow or pressure communication from the upper chamber 46 to the lower chamber 48. Accordingly, fluid can only flow from the upper chamber 46 to the lower chamber 48 via the pump 50.

In addition, fluid can only flow from the lower chamber 48 to the upper chamber 46 via the valve system 82 (the orifice 85 allows flow from the lower chamber 48 to the upper chamber 46, but holds a back pressure). In some examples, the valve system 82 may optionally include the 500 psi (~3447 kPa) relief valve 56.

At a beginning of stage 3 of the FIG. 9 table (the first row of stage 3 in the table), the wellbore 16 pressure has increased to 500 psi (~3447 kPa). The pilot operated check valve 80 closes and the secondary relief valve 83 (set at 200 psi or ~1380 kPa) opens, as indicated in the second row of stage 3 in the FIG. 9 table.

The wellbore 16 pressure (or the bottom chamber 48 pressure) then causes the first relief valve 56 (which is set at 500 psi or ~3447 kPa) to open. Stage 4 of the FIG. 9 table shows a manipulation of the wellbore 16 pressure back to a lower pressure (in this example, 200 psi or ~1380 kPa), in order to reset and/or re-enable the pilot operated check valve 80.

The relief valve 56 itself (without the valve system 82) can be the same as the valve 56 in the FIGS. 2D & 3 examples. The relief valve 56 in the FIG. 9 example becomes the active valve determining the pressure differential between the upper and lower chambers 46, 48 when the pilot operated check valve 80 is closed.

Figure 10:
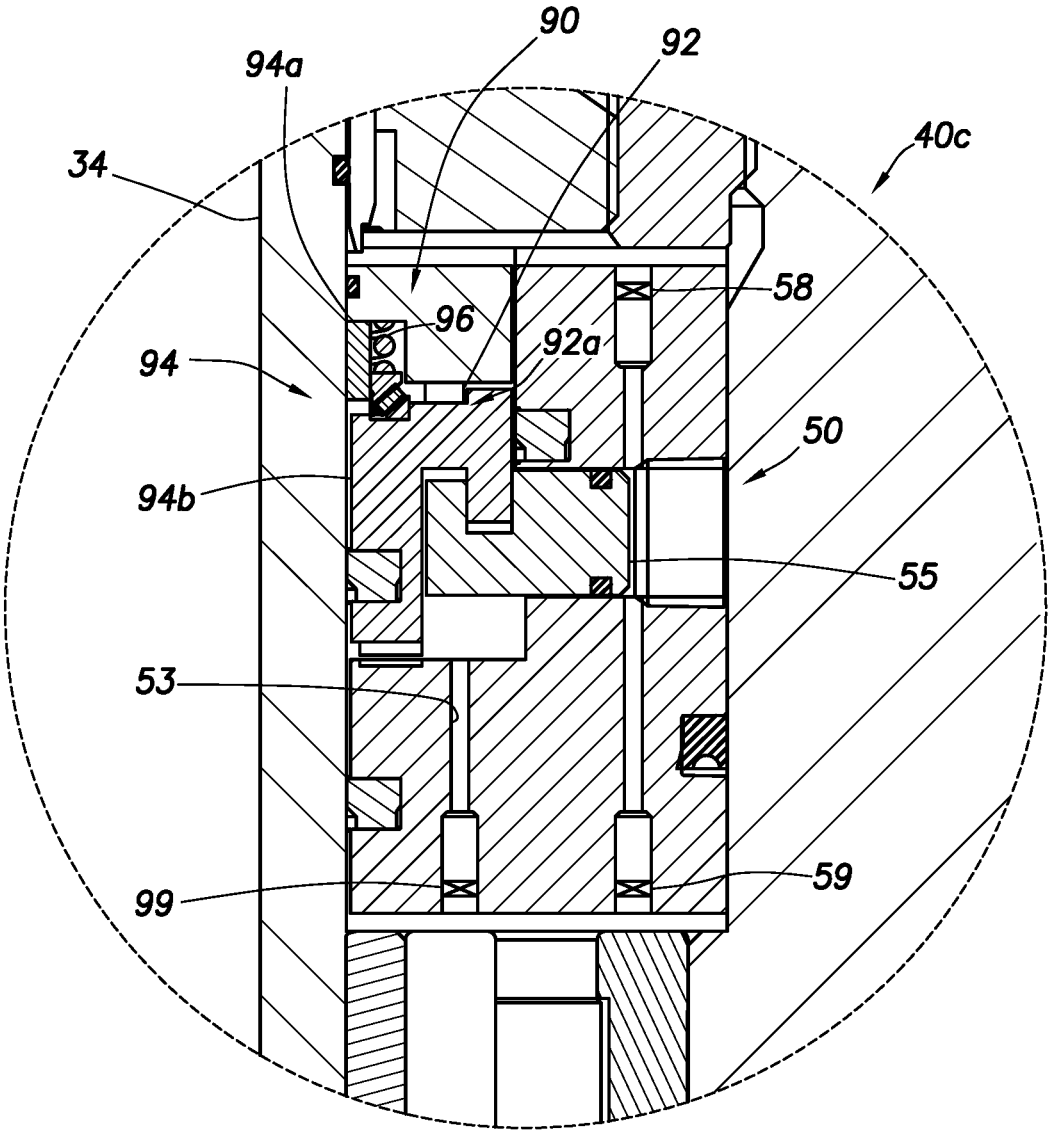
FIG. 10 is a representative partially cross-sectional view of another example of a radial seal pressure reduction system having a clutch, wherein the clutch is engaged.
Figure 11:
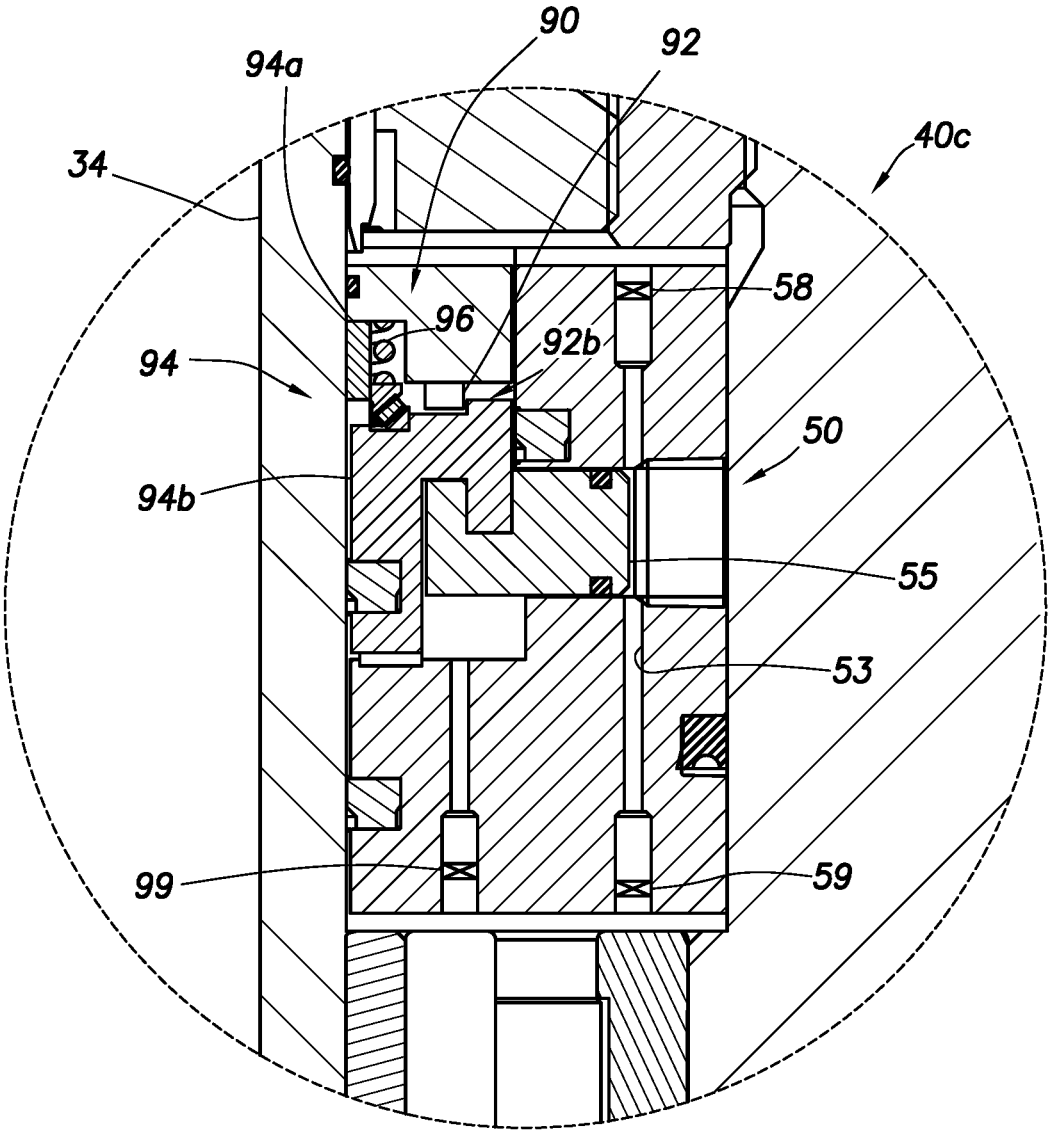
FIG. 11 is a representative partially cross-sectional view of the radial seal pressure reduction system of FIG. 10, wherein the clutch is disengaged.

Referring additionally now to FIGS. 10 & 11, a partial cross-sectional view of another example of the radial seal pressure reduction system 40*c* is representatively illustrated. In this example, the pressure reduction system 40*c* includes a clutch 90.

The pump 50 initially does not function, until a certain set pressure is reached to engage the clutch 90. In FIG. 10, the clutch 90 is shown in an engaged position 92*a*, and in FIG. 11 the clutch 90 is in a disengaged position 92*b*.

In this example, the clutch 90 includes teeth 92 and may be positioned adjacent to a split wobble sleeve 94. The split wobble sleeve 94 may comprise a top part/ring 94*a* and a bottom part 94*b*.

The top part/ring 94*a* of the wobble sleeve 94 may rotate or move in connection with a rotatable member 34 of the bearing assembly 32. The top part/ring 94*a* of the wobble sleeve 94 may also be connected to the teeth 92 of the clutch 90.

In the engaged position 92*a* (FIG. 10), the teeth 92 may engage the bottom part 94*b* of the split wobble sleeve 94. Rotary motion from the rotatable inner member 34 is transferred to the top and bottom parts 94*a*, 94*b* of the wobble sleeve 94, which then transfers or imparts radial motion to the piston 55 of the pump 50. Thus, the pump 50 is activated or engaged to move the fluid volume 51.

In the disengaged position 92*b* of the clutch 90 (FIG. 11), the piston 55 is not displaced by the rotary motion of the top part/ring 94*a* of the split wobble sleeve 94 or the rotatable inner member 34. The top part/ring 94*a* may also include a spring 96 to bias the top part/ring 94*a* of the wobble sleeve 94 to the disengaged position (FIG. 11).

To start the pump 50, the wellbore 16 pressure must increase to counteract the spring 96 biasing force (e.g., a force or pressure of 10 psi (~6.9 kPa) may be required to initially activate/engage the clutch 90). The pressure required to engage the clutch 90 may be subsequently changed or altered (by way of example, to 50 psi or ~345 kPa) after the first engagement.

Figures 12, 13:
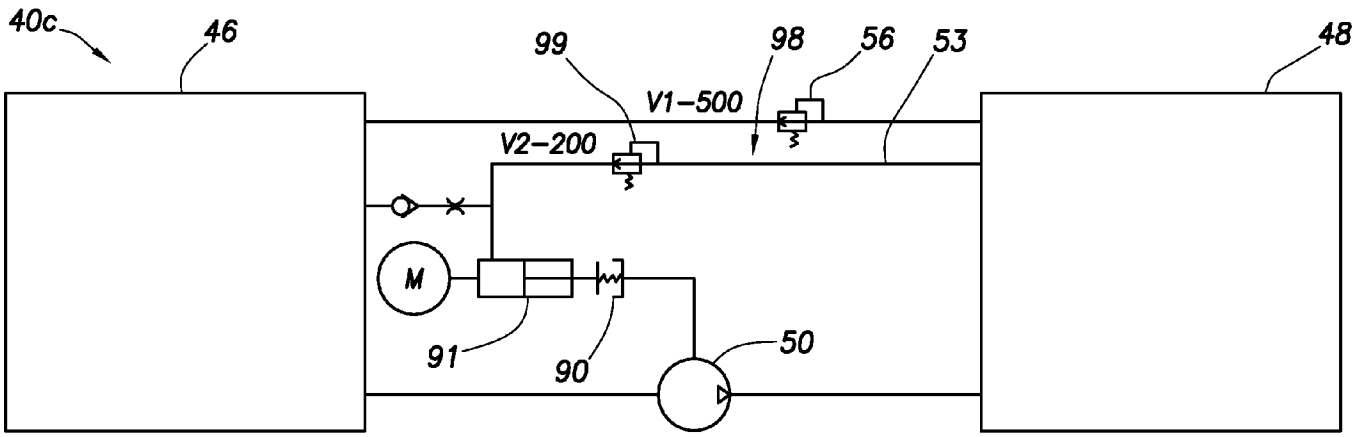
FIG. 12 is a representative schematic view of the radial seal pressure reduction system of FIGS. 10 & 11.
FIG. 13 is a representative table of pressure values during operation utilizing the radial seal pressure reduction system of FIGS. 10-12.

Referring additionally now to FIG. 12, a schematic view of the radial seal pressure reduction system 40*c* of FIGS. 10 & 11 is representatively illustrated. In the FIGS. 10-12 example, communication between the top chamber 46 and the bottom chamber 48 is controlled by a system of flow paths 53 and a bypass valve system 98, including a clutch 90, a hydraulic cylinder 91 and a motor M, and optionally relief valves 56, 99 (which may be used for moderating the pressure differential between the chambers 46, 48).

The clutch 90 and the bypass valve system 98 disengage the pump 50 at relatively low wellbore 16 pressures, thus keeping pressure in the bottom chamber 48 near the wellbore 16 pressure, until the wellbore 16 pressure increases to the relief valve 99 setting. The relief valve 56 and pump 50 are also included in the radial seal pressure reduction system 40*c* to move the fluid 51 between the two chambers 46, 48 through the flow paths 53.

The motor M is a schematic representation of the rotatable inner member 34, which in this example rotates with the tubular 14 (see FIG. 1). When the relief valve 99 is opened, the pressurized fluid 51 enters the hydraulic cylinder 91 and the hydraulic cylinder 91 extends to engage the clutch 90. The pump 50 begins pumping when the clutch 90 is engaged.

Representatively illustrated in FIG. 13 is a table of pressure values for different stages of a wellsite 10 operation utilizing the radial seal pressure reduction system 40*c* of FIGS. 10-12. In stage 1 of the FIG. 13 table, the wellbore pressure 16 is at zero, all of the relief valves 56, 99 are closed (since the pressures are less than the relief valves 56, 99 set points, and the clutch 90 does not have the requisite pressure for the wobble sleeve 94 parts 94*a*, 94*b* to engage). Thus, the pump 50 is not actuated.

At an initial period of stage 2, the wellbore 16 pressure is increased to 250 psi (~1725 kPa), which causes the bottom chamber 48 to have a pressure of 300 psi or ~2070 kPa (due to increased pressure of 50 psi or ~345 kPa from the bottom compensator 70, as depicted in FIGS. 2A-2D). The pressure of 300 psi is sufficient to open/overcome the relief valve 99, which is set to 200 psi (~1380 kPa).

The fluid 51 travels through the flow paths 53 to further engage and activate the clutch 90, which in turn engages the pump 90 and moves the fluid 51 to the bottom chamber 48. As a result, in the subsequent stabilized period of stage 2 (the second row of the second stage in the FIG. 13 table), the bottom chamber 48 pressure reaches 550 psi (~3.8 MPa), which also triggers the opening of the relief valve 56, set at 500 psi (~3.5 MPa).

In stage 3, the wellbore 16 pressure is decreased to 100 psi (~690 kPa). In an initial period (the first row of stage 3 in the table), the pressure in the bottom chamber 48 is still 550 psi (~3.8 MPa) as in stage 2, and the relief valves 56, 99 are still open, and the clutch 90 is still engaged.

However, as the pressure from the wellbore 16 affects the pressure reduction system 40, as shown in the second row of stage 3, the bottom chamber 48 pressure decreases to 150 psi (~1035 kPa) and the relief valves 56, 99 close (since the pressure is now below their example set points of 500 psi (~3450 kPa) and 200 psi (~1380 kPa) respectively). Accordingly, the clutch 90 also disengages as stage 3 stabilizes.

In an initial period of stage 4 (the first row of stage 4 in the FIG. 13 table), the wellbore 16 pressure is increased to 200 psi, which causes the bottom chamber 48 pressure to increase to 250 psi (~1725 kPa). This pressure is sufficient to open the relief valve 99 and engage the clutch 90. Subsequently, the pressure is transferred through the relief valve 56 and through the pump 50, and back to the bottom chamber 48, to raise the bottom chamber 48 pressure up to 550 psi (~3.8 MPa), which also opens the relief valve 56.

Figure 14:
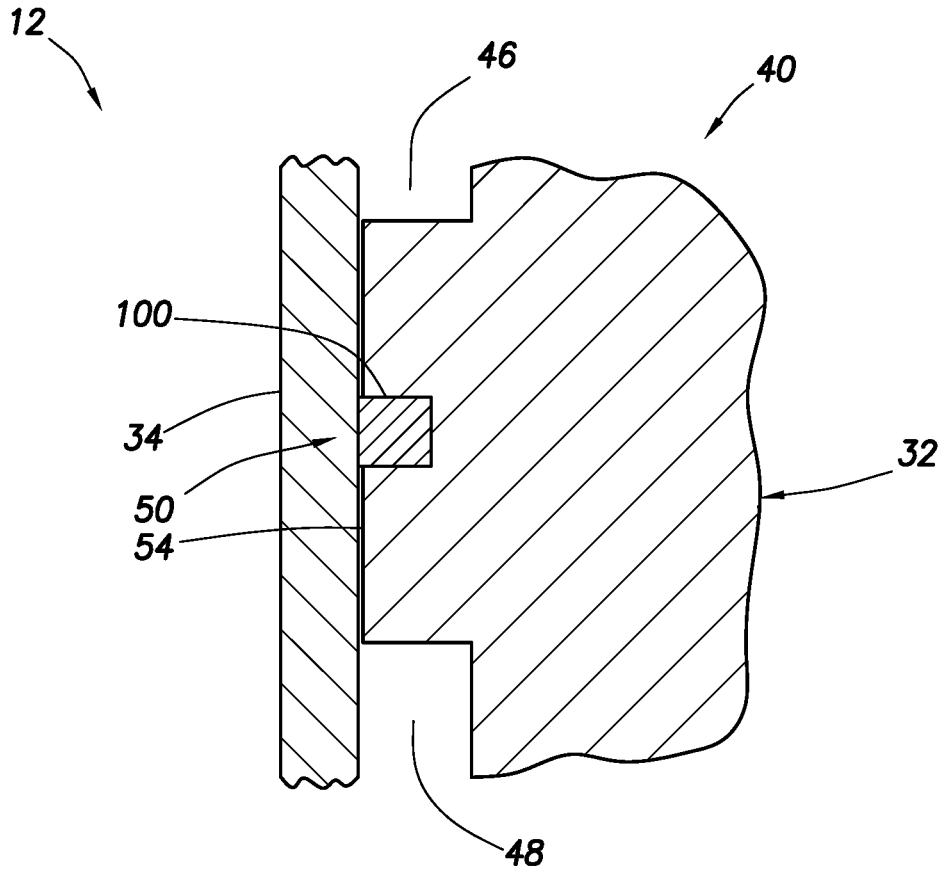
FIG. 14 is a representative schematic elevational view of another example of a pump of the radial seal pressure reduction system.

Referring additionally now to FIG. 14, a schematic cross-sectional view of another example of the radial seal pressure reduction system 40 is representatively illustrated. In this example, the pump 50 pumps fluid 51, 68 (see FIGS. 2A-D) from the upper chamber 46 to the lower chamber 48 in response to relative rotational displacement between the rotatable member 34 and a pump member 100 that slidingly contacts the rotatable member 34.

In one example, the pump member 100 could comprise a radial seal that is configured to displace fluid 51, 68 across an area of sliding contact between the pump member 100 and the rotatable member 34. A suitable radial seal for use as the pump member 100 is the HIGH FILM KALSI SEAL™ marketed by Kalsi Engineering, Inc. This radial seal has a "wavy" inner contact surface that induces fluid displacement between the seal and a surface contacted by the seal. However, other types of pumping radial seals may be used in other examples.

Note that it is not necessary for the pump member 100 to comprise a radial seal. In other examples, the pump member 100 could comprise another type of pumping element. The pump member 100 may also be constructed of any of a variety of different materials, such as, brass, other metals and alloys, composites, elastomers, plastics, etc. The scope of this disclosure is not limited to any particular configuration of the pump member 100.

It may now be fully appreciated that the above disclosure provides significant advancements to the arts of constructing and utilizing pressure control devices for well operations. In examples described above, pressure differentials across radial seals are reduced by pumping fluid from a chamber at relatively low pressure (e.g., somewhat greater than atmospheric or surface 20 pressure) to another chamber at relatively high pressure (e.g., somewhat greater than wellbore 16 pressure). A pump is operated to pump the fluid between the chambers when a rotatable member is rotated.

The above disclosure provides to the art a pressure control device 12 for sealing about a tubular 14 at a wellsite 10. In one example, the pressure control device 12 can include a rotatable member 34, first and second radial seals 42, 44 that sealingly contact the rotatable member 34, first and second fluid chambers 46, 48, the second chamber 48 being exposed to the rotatable member 34 between the first and second radial seals 42, 44, and a pump 50 that pumps fluid 51, 68 from the first chamber 46 to the second chamber 48 in response to rotation of the rotatable member 34.

Rotation of the rotatable member 34 may displace a piston 55 of the pump 50 in some examples. The second chamber 48 may be exposed to bearings 38 that rotatably support the rotatable member 34.

The fluid 51, 68 may flow from the second chamber 48 to the first chamber 46 via at least one flow path 53. The fluid 51, 68 may flow to the first chamber 46 in response to pressure in the second chamber 48 being greater than pressure in the first chamber 46 by a predetermined amount. This predetermined amount may correspond to an opening pressure of the relief valve 56, a back pressure maintained by the orifice 85, an opening pressure of the relief valve 84, an opening pressure of the relief valve 99, a setting of the valve system 82 or 98, etc.

Pressure in the second chamber 48 may be maintained greater than wellbore 16 pressure exposed to the pressure control device 12. Pressure in the first chamber 46 may be maintained greater than atmospheric pressure exposed to the pressure control device 12.

The pump 50 may comprise at least one piston 55 that reciprocates in response to rotation of the rotatable member 34. The piston 55 may reciprocate radially relative to the rotatable member 34.

The pump 50 may comprise a pump member 100 that slidingly contacts the rotatable member 34 and pumps the fluid 51, 68 in response to relative sliding displacement between the pump member 100 and the rotatable member 34.

The pump 50 may be positioned between the first and second radial seals 42, 44. The pump 50 may pump the fluid 51, 68 in response to rotation of the rotatable member 34, but only if wellbore 16 pressure is greater than a predetermined level. In some examples, this level may be set by requiring a certain pressure to actuate a clutch 90. The pressure may correspond to an opening pressure of the relief valve 99.

Also provided to the art by the above disclosure is a pressure reduction system 40 for use with a pressure control device 12 at a wellsite 10. In one example, the pressure reduction system 40 can comprise a pump 50 that pumps fluid 51, 68 from a first chamber 46 to a second chamber 48, the second chamber 48 being exposed to a rotatable member 34 of the pressure control device 12 between first and second radial seals 42, 44 that sealingly contact the rotatable member 34. The pump 50 pumps the fluid 51, 68 in response to rotation of the rotatable member 34.

A method of operating a pressure control device 12 at a wellsite 10 can comprise: providing at least first and second chambers 46, 48 in a bearing assembly 32 of the pressure control device 12; and regulating pressures in the first and second chambers 46, 48 via a valve system 82, 98 in communication with both of the first and second chambers 46, 48.

The method can include pumping fluid 51, 68 from the first chamber 46 to the second chamber 48 in response to rotation of a rotatable member 34 of the pressure control device 12, the second chamber 48 being exposed to the rotatable member 34 of the pressure control device 12 between first and second radial seals 42, 44 that sealingly contact the rotatable member 34. The second chamber 48 may be exposed to bearings 38 of the pressure control device 12 that rotatably support the rotatable member 34.

The pumping step may be performed in response to rotation of the rotatable member 34 only if wellbore 16 pressure is greater than a predetermined level. The pumping step may include reciprocating a piston 55 radially relative to the rotatable member 34.

The regulating step may include fluid 51, 68 flowing to the first chamber 46 in response to the pressure in the second chamber 48 being greater than the pressure in the first chamber 46 by a predetermined amount. The regulating step may comprise the pressure in the second chamber 48 being maintained greater than wellbore 16 pressure exposed to the pressure control device 12. The pressure in the first chamber 46 may be maintained greater than atmospheric pressure exposed to the pressure control device 12.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A pressure control device for sealing about a tubular at a wellsite, the pressure control device comprising:

a rotatable member;

first and second radial seals that sealingly contact the rotatable member;

first and second fluid chambers, the second chamber being exposed to the rotatable member between the first and second radial seals; and a pump that pumps fluid from the first chamber to the second chamber in response to rotation of the rotatable member.

2. The pressure control device of claim 1, wherein rotation of the rotatable member displaces a piston of the pump.

3. The pressure control device of claim 1, wherein the second chamber is exposed to bearings that rotatably support the rotatable member.

4. The pressure control device of claim 1, wherein the fluid flows from the second chamber to the first chamber via at least one flow path.

5. The pressure control device of claim 4, wherein the fluid flows to the first chamber in response to pressure in the second chamber being greater than pressure in the first chamber by a predetermined amount.

6. The pressure control device of claim 1, wherein pressure in the second chamber is maintained greater than wellbore pressure exposed to the pressure control device.

7. The pressure control device of claim 1, wherein pressure in the first chamber is maintained greater than atmospheric pressure exposed to the pressure control device.

8. The pressure control device of claim 1, wherein the pump comprises at least one piston that reciprocates in response to rotation of the rotatable member.

9. The pressure control device of claim 8, wherein the piston reciprocates radially relative to the rotatable member.

10. The pressure control device of claim 1, wherein the pump comprises a pump member that slidingly contacts the rotatable member and pumps the fluid in response to relative sliding displacement between the pump member and the rotatable member.

11. The pressure control device of claim 1, wherein the pump is positioned between the first and second radial seals.

12. The pressure control device of claim 1, wherein the pump pumps the fluid in response to rotation of the rotatable member only if wellbore pressure is greater than a predetermined level.

* * * * *